US005311952A

United States Patent [19]

Eddison et al.

[11] Patent Number: 5,311,952

[45] Date of Patent: May 17, 1994

[54] APPARATUS AND METHOD FOR DIRECTIONAL DRILLING WITH DOWNHOLE MOTOR ON COILED TUBING

[75] Inventors: Alan Eddison, Houston, Tex.; Lawrence J. Leising, Broken Arrow, Okla.; Charles Ingold, Houston, Tex.

[73] Assignee: Schlumberger Technology Corporation, Houston, Tex.

[21] Appl. No.: 887,503

[22] Filed: May 22, 1992

[51] Int. Cl.[5] ..... E21B 7/08

[52] U.S. Cl. ..... 175/61; 175/74; 175/107

[58] Field of Search ..... 175/26, 38, 45, 61, 175/73, 74, 107

[56] References Cited

U.S. PATENT DOCUMENTS

| | | | |
|---|---|---|---|
| 4,374,547 | 2/1983 | Nguyen et al. | 175/45 |
| 4,655,289 | 4/1987 | Schoeffler | 166/320 |
| 4,655,299 | 4/1987 | Shoeffler | 175/38 |
| 4,789,032 | 12/1988 | Rehm et al. | 175/45 |
| 4,914,637 | 4/1990 | Goodsman | 367/83 |

OTHER PUBLICATIONS

A. B. Ramos Jr., et al., "Horizontal Slim-Hole Drilling with Coiled Tubing: An Operator's Experience", IADC/SPE 23875, pp. 289-300, Feb. 18-21, 1992, New Orleans, La.

E. M. Traonmillin et al., "First Field Trial of a Coiled Tubing for Exploration Drilling", IADC/SPE 23876, pp. 301-308, Feb. 18-21, 1991, New Orleans, La.

H. R., Wesson Jr., "New Horizontal Drilling Techniques Using Coiled Tubing", SPE 23951, Mar. 18-19, 1992.

*Primary Examiner*—David J. Bagnell

*Attorney, Agent, or Firm*—David L. Moseley; Wayne I. Kanak; John J. Ryberg

[57] ABSTRACT

A downhole adjustable orienting sub is included in a directional drilling tool string that is run into the borehole on coiled tubing. The bent housing of the tool string defines a bend angle and a bend point, and the bend point is oriented about the center of the bore by operating the orienting sub. The level of the reactive torque applied to the bent housing as the bit drills on bottom is controlled by selecting the amount of the weight of the coiled tubing that is applied to the bit. The orienting sub can be indexed downhole to provide different orientations of the bend point by temporarily reducing and then increasing the mud flow rate.

23 Claims, 2 Drawing Sheets

APPARATUS AND METHOD FOR DIRECTIONAL DRILLING WITH DOWNHOLE MOTOR ON COILED TUBING

FIELD OF THE INVENTION

This invention relates generally to directional drilling with a tool string that is suspended in the borehole on coiled tubing, and particularly to a downhole adjustable orienting tool that is included in the drilling tool string and used to orient the bent housing thereof in a manner such that the azimuth of the borehole can be controlled.

BACKGROUND OF THE INVENTION

Typical directional drilling procedures occasionally require that the drill string be turned at the surface in order to generate torque at the bottom thereof which will orient the bent housing in a manner so that the bit is steered azimuthally. The transmission of such torque can be done when a conventional drill pipe string is used, since it is quite rigid. An attractive alternative to drill pipe is coiled tubing which has been used in the past primarily in connection with well workover and repair operations, as well as stimulation. Coiled tubing has a relatively small size in the range of $\frac{3}{4}$–$2\frac{7}{8}$ inch, and a thin wall section of about 5/32 inch, which makes it flexible to the extent that many thousands of feet can be wound on a reel having a relatively small diameter in the order of 9–10 feet. Coiled tubing has the advantage over conventional drill pipe in that it can be run into and out of a well very quickly since there are no threaded joint connections to make up or break out, and the absence of threaded connections enables coiled tubing to be run while under pressure and while fluids are being pumped through it. However, coiled tubing has not heretofore been widely used to run a directional drilling tool string for the principle reason that is not possible to rotate coiled tubing at the surface to accomplish steering, on account of its storage on the reel. Thus it was thought that there was no effective way to steer the bit if coiled tubing is used as the running string.

It has been recognized that when a downhole motor is rotating the bit on bottom while weight (WOB) is being applied thereto, a reactive torque in the counterclockwise direction is applied to the housing of the motor, which includes the bent housing. The level of such counter-torque is directly proportional to the weight-on-bit, and has its maximum level at motor stall. Such reactive torque, and the presence of a bend point in the bent housing, causes lateral forces to be applied to the bit which tend to change the direction of the borehole. However, to control the direction, there must be a way to orient the bend point about the axis of the borehole. As noted above, this is accomplished when using a conventional drill pipe string by simply turning it at the surface. However, coiled tubing cannot be manipulated in this manner. The present invention provides a means and method of orienting the bent housing and its bend point downhole, which enables a directional drilling tool string to be run on coiled tubing.

In accordance with this invention, the drilling tool string includes a downhole adjustable orienting sub by which the relative angular orientation of the bend point established by the bent housing can be changed, as needed, to cause the bit to drill at a certain heading. Variations in the weight of the coiled tubing that is applied to the bit can be used to vary the level of the reactive torque and the resulting torsional wind-up angle of the bottom end of the coiled tubing, and also the lateral force on the bit, so that it will drill a borehole along a planned course. This drilling procedure also employs a measuring-while-drilling (MWD) tool that makes directional measurements and transmits signals representative thereof to the surface. Measurements are made of three orthogonal components of the earth's gravity field, from which the inclination of the borehole can be determined, and three orthogonal components of the earth's magnetic field from which azimuth of the borehole can be determined. These measurements, together with tool geometry, also permits "toolface" angle to be determined and displayed at the surface, along with the inclination and azimuth values while drilling is in progress. As used herein, the term "toolface" means the orientation angle of the bent housing or sub in the borehole with respect to a reference such as high side of the borehole which indicates the direction in which the borehole will be curving.

The general object of the present invention is to provide a directional drilling tool string of the type described which is run on coiled tubing and which includes an orientation sub that can be adjusted downhole to fix the angular orientation of the bend point in the bent housing or sub with respect to the axis of the borehole so that the direction of the borehole can be controlled.

Another object of the present invention is to provide a directional drilling tool string of the type described where the bent housing can be oriented downhole to various angular positions, and where the amount of weight-on-bit can be varied to change the reactive torque and wind-up angle in a manner such that a directional hole having a desired trajectory will be drilled.

SUMMARY OF THE INVENTION

These and other objects are attained in accordance with the concepts of the present invention through the provision of a direction drilling tool string which is lowered into the borehole at the lower end of coiled tubing which is wound off of and onto the reel of a coiled tubing unit at the surface. The tubing is injected into the top of the well through a stripper and a blowout preventer which provide pressure control. The tool string includes a bit, a mud motor having a bent housing, or a bent sub above the mud motor, an MWD tool or a wireline steering tool that measures inclination, azimuth and toolface angle and transmits signals representative thereof to the surface, and an orienting sub located above the MWD tool and attached to the lower end of the coiled tubing. The bent housing or sub provides a bend angle which causes the bit to drill along a curved path, and the orienting sub can be adjusted downhole to provide selected orientation angles of the bent housing or sub in the borehole. While drilling is in progress, the reactive torque on the bent housing, which produces a wind-up angle, varies with the amount of WOB and is opposed by the torsional spring effect of the lower end portion of the coiled tubing so that the bent housing will remain in a selected orientation. Where the borehole azimuth needs correction as indicated by the signals from the MWD tool, the weight-on-bit can be changed by surface manipulation of the coiled tubing to achieve the desired correction, or the orienting sub can be indexed to another position, or both.

The orienting sub includes an angular indexing system that is adjusted downhole, preferably in response to changes in the flow rate of the drilling mud that is being pumped down through the coiled tubing to operate the motor. From a reference angular position for example, where the bend point defined in the bent housing is adjacent the low side of the borehole, so that the bit will tend to drill at the same azimuth while building inclination angle, a plurality of index positions are available where the bend point is positioned at other selected angles with respect to such reference throughout 360° of revolution. Thus the orienting tool can be indexed to achieve a certain general azimuthal heading, and a more precise heading achieved by varying the WOB. The MWD tool or wireline steering tool makes measurements from which the inclination and azimuth of the borehole adjacent the motor can be determined on a substantially continuous basis, as well as toolface angle, and transmits representative mud pulse or electrical signals to the surface so that the WOB and/or the angular position of the orienting sub can be adjusted as drilling proceeds to keep the bit on a desired course.

BRIEF DESCRIPTION OF THE DRAWINGS

The present invention has other objects, features and advantages which will become more clearly apparent in connection with the following detailed description of a preferred embodiment, taken in conjunction with the appended drawings in which.

DETAILED DESCRIPTION OF A PREFERRED EMBODIMENT

Figure 1:
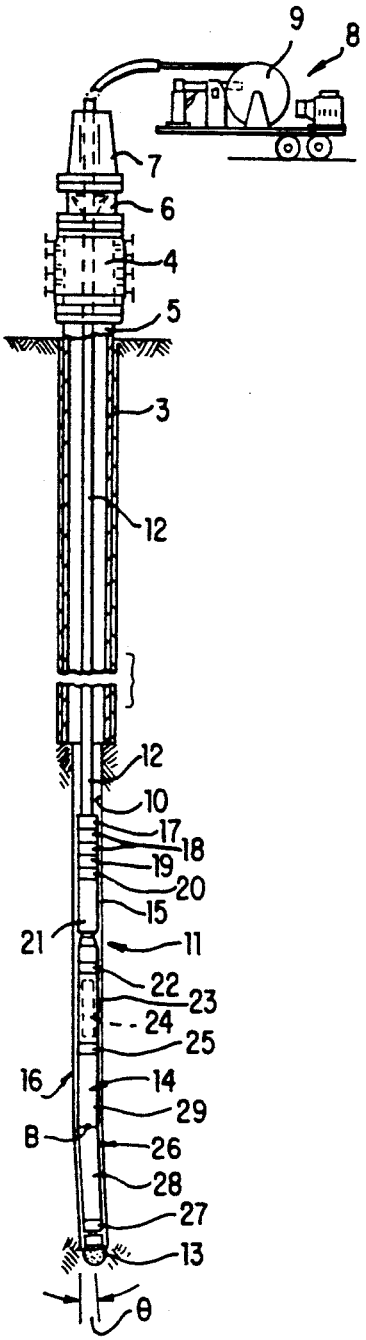
FIG. 1 is a schematic view of a direction drilling tool string suspended in a well bore on coiled tubing which is fed from the reel of a coiled tubing unit at the surface.

FIG. 1 illustrates schematically the drilling of a borehole 10 using a string of directional drilling tools indicated generally at 11 which is suspended in the borehole on coiled tubing 12. The tool string 11 includes a bit 13 that is rotated by a mud motor 14 in response to the flow of drilling mud under pressure which is pumped down the bore of the coiled tubing 12 and through the motor, out the jets of the bit 13, and back up to the surface through the annulus 15. The coiled tubing 12 is formed in a continuous length which is wound on the spool 9 of a coiled tubing unit 8 which is parked near the wellhead 5 at the surface. The coiled tubing 12 typically is inserted into the top of the wellbore through a stripper 6 and a blow-out preventer 4 by operation of an injector 7. An additional advantage of using coiled tubing for directional drilling is that the drilling can be done near or at underbalance conditions to achieve greater rates of penetration. The preventer 4 typically is bolted to a well head 5 at the top of casing 3 that has been cemented in place so that it lines the upper part of the borehole 10. The tool string 11 is shown being used to drill a section 16 of the borehole 10 below the lower end of the casing 3. In an exemplary case, the casing 3 can have an outer diameter of 4½ inches, while the drilling tool string 11 has an outer diameter of slightly over 3 inches. The coiled tubing 12 can have an outer diameter in the order of 1¾ inches.

The tool string 11 is connected to the lower end of the coiled tubing 12 by various components including a coiled tubing connector 17, a pair of upwardly closing check or float valves 18, a quick-release sub 19, and a cross-over sub 20. The check valves 18 can be hinged flapper devices, and the release sub 19 can include a sleeve having an upwardly facing ball seat that is held by shear pins. To release the device 19 in the event the tool string 11 should become stuck in the borehole, a ball is circulated down the coiled tubing 12 until it engages the seat and allows the pins to be sheared by differential pressure forces. When the pins shear, the release sub 19 separates so that the coiled tubing 12 can be removed from the well, and the tool string 11 later recovered by a fishing operation.

The cross-over sub 20 has different types and/or sizes of threads on its opposite ends which allow connection to the threads on the upper end of an orienting tool 21 which is constructed in accordance with the present invention. The lower end of the orienting tool 21 is attached to another cross-over sub 22 which connects to the upper end of a housing or collar 23 which is made of a suitable non-magnetic metal. An MWD tool 24 is mounted inside the collar 23, as shown in phantom lines. Although the MWD tool 24 can measure numerous downhole parameters and formation characteristics, for purposes of this description the tool includes an accelerometer package which measures the inclination of the borehole with respect to vertical, and a magnetometer package that measures the azimuth of such inclination. These two measurements, hereinafter called directional measurements, can be converted from analog to digital or other form and then transmitted up to the surface in the form of mud pulses in the mud stream inside the coiled tubing 12. A surface pressure sensor (not shown) detects the signals and applies them to a signal processor where the analog values of the directional measurements are reconstructed. The MWD tool 24 can operate on a substantially continuous basis so that downhole directional parameters can be monitored at the surface at all times as the drilling proceeds. Although several types of MWD tools 24 could be used, one suitable tool is disclosed and claimed in commonly-owned U.S. Pat. No. 4,914,637. A steering tool that is connected to the lower end of a wireline electrical cable which extends up through the coiled tubing 12 to the surface also can be used in lieu of, or in addition to, the MWD tool 24.

The MWD collar 23 is connected to the upper end of the mud motor 14 by a universal orienting sub 25 which is well known per se. The motor 14 preferably is a "Moyno"-type positive displacement device which has a spiral ribbed rotor that rotates within a lobed stator, there usually being one less rib than lobe. When drilling mud is pumped through it, the rotor turns and drives an output shaft which is connected to its lower end by a suitable universal joint. The drive shaft extends down through the bore of the bent housing 26 of the motor 14 to where it drives the upper end of a spindle that is mounted in a bearing housing 27 and which has the drill bit 13 connected to its lower end. The bent housing 26 has a lower section 28 which is connected at a bend angle Θ to its upper section 29 so as to provide a bend point B. One bent housing assembly 26 that can be used is adjusted at the surface to provide the desired bend angle Θ, and is disclosed and claimed in U.S. application Ser. No. 07/722,073, filed Jun. 27, 1991 now abandoned, also assigned to the assignee of this invention. On account of the bend angle Θ the drill bit 13 will tend to drill along a curved path having a radius that is related to the magnitude of the bend angle.

Figure 2A:
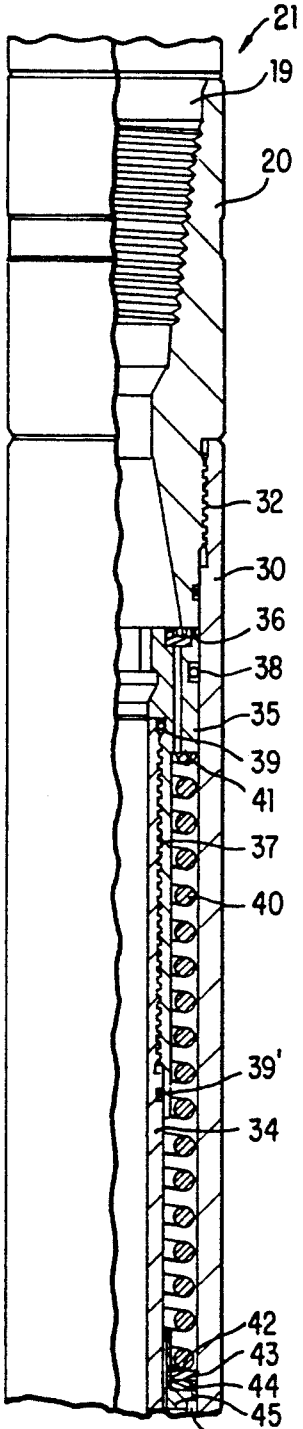
FIGS. 2A–C are successive longitudinal sectional views, with some parts in side elevation, of the orienting tool of the present invention.
Figure 2B:
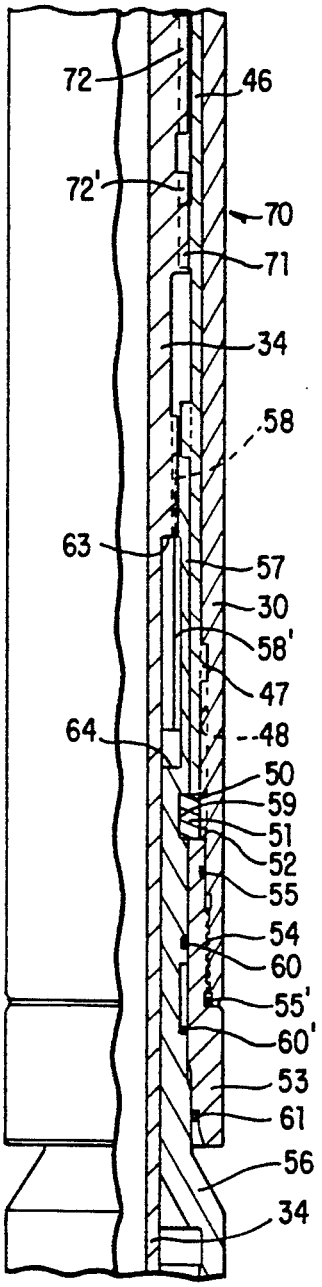
Figure 2C:
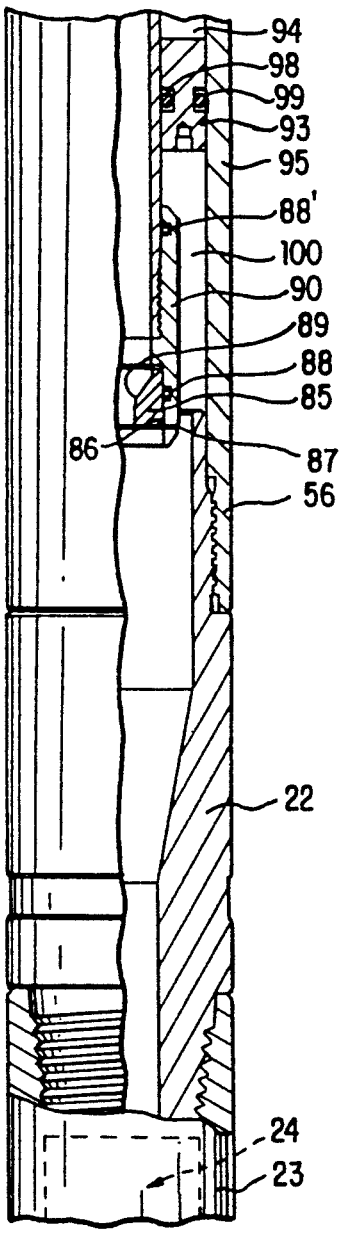

In accordance with a principle feature of the present invention, the orienting tool 21 can be used to adjust the angular orientation of the bend point B about a longitudinal axis that is tangent to the curved central axis of the borehole. Such angular adjustments, together with changes in the weight being applied to the bit 13 which produces resultant changes in bit torque, reactive torque and the wind-up angle on the coiled tubing string, are used to effect directional drilling of the borehole in a desired manner. As illustrated in FIGS. 2A–2C, the downhole adjustable orienting tool 21 includes an upper tubular housing 30 having its upper end connected by threads 32 to the upper sub 20. A mandrel assembly 34 is mounted from reciprocating movement within the housing 30 between an upper position shown in FIG. 2A where an outwardly directed annular flange or piston 35 thereon is up against an internal shoulder 36 which is provided by the lower end face of the upper sub 20, and a lower position where downward movement is stopped as will be explained below. The piston 35 can be formed on a separate sleeve, as shown, which is threaded to the upper end of the mandrel 34 at 37. The piston 35 carries an O-ring seal 38 which prevents fluid leakage, and additional O-rings 39, 39′ are used to prevent leakage past the threads 37. An elongated spring means which can be a coiled power spring 40, or a stack of Bellville washers, surrounds the mandrel 34 and reacts between the downwardly facing surface 41 of the piston 35 and an upwardly facing shoulder 42 provided by a ring 43 which is fixed with respect to the housing 30. A thrust bearing 44 can be positioned between the ring 43 and a retainer 45 to facilitate rotation of the lower end of the spring 40 relative to the retainer 45 and to prevent spring-back. The spring 40 preferably is preloaded during assembly, that is, it has a relaxed length that is longer than shown in FIG. 2A so that it is compressed somewhat and exerts upward force on the piston 35 in its upper position.

The retainer ring 45 rests on the upper end of an index sleeve 46. As shown in FIG. 2B, the lower portion of the sleeve 46 has a plurality of longitudinal spline ribs 47 which are received by companion internal grooves 48 on the lower end portion of the housing 30 to prevent relative rotation between these members. The lower end surface 50 of the index sleeve 46 engages a split bearing ring 51 whose outer portion rests on the upper end surface 52 of a lower sub 53 that is threaded at 54 to the lower end of the upper housing 30. Seal rings 55, 55′ prevent leakage through the threads 54. The elements 47, 48 and the bearing ring 51 fix the index sleeve 46 within the upper housing 30.

A lower tubular housing 56 extends up into the lower end of the upper housing 30 and includes an upper section 57 that is slidably and rotatably coupled to the mandrel 34 by splines 58 and 58′. An external annular recess 59 in the housing 56 receives the inner portion of the bearing ring 51, which allows relative rotation between the lower housing 56 and the upper housing 30, but which prevents relative longitudinal movement. Redundant seal rings 60, 60′ can be used to prevent fluid leakage between the lower sub 53 and the lower housing 56, and a wiper ring 61 is employed to prevent debris in the well fluids from contacting the seal 60′. The splines 58 and 58′ cause the lower housing 56 to rotate with the mandrel 34, while allowing relative longitudinal movement. As shown, the bending support length between approximately the upper end of the splines 58′ and the wiper ring 61 is at least one and one-half times and preferably as much as about four and one half times, the inner diameter of the lower sub 53 to prevent binding of parts in severely curved hole segments such as doglegs.

Figure 3:
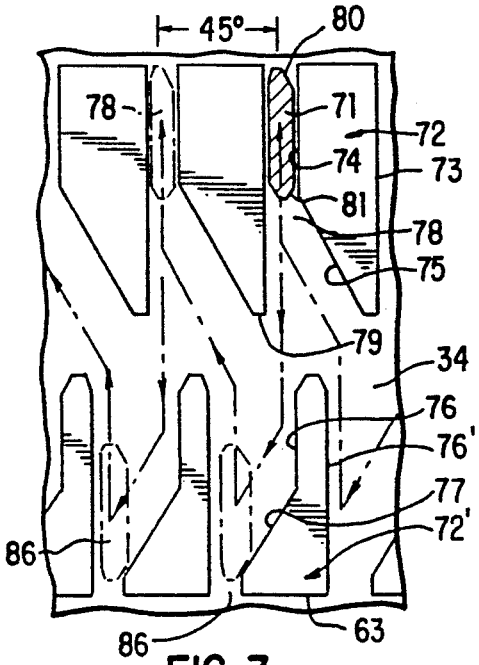
FIG. 3 is a developed plan view showing cam bodies and followers that are used in the apparatus shown in FIG. 2 to achieve various orientation angles.

An indexing system indicated generally at 70 in FIG. 2B is used to cause the mandrel 34, and thus the lower housing 56, to rotate through consecutive angularly spaced positions relative to the upper housing 30 in response to cycles of upward and downward movements of the mandrel. As shown in developed plan view in FIG. 3, the indexing system includes a plurality of circumferentially spaced, inwardly projecting lugs 71 (only one shown) on the index sleeve 45 that cooperate with sets of cam bodies 72, 72′ which are formed on the mandrel 34 at upper and lower levels thereon. Each lug 71 preferably is generally rectangular to provide large drive areas on the sides thereof. Each of the upper cam bodies 72 has opposite side walls 73, 74 and a downwardly facing inclined wall 75. Each of the lower bodies 72′ also has opposite facing side walls 76, 76′ and an upwardly facing wall 77 that inclines in a direction that is opposite to the inclination of the wall 75 on an upper body 72. The side wall 74 of each upper body 72 preferably is longitudinally aligned with the side wall 76 of each lower body 72′, so that the upper portion of the inclined wall 77 on the lower body 72′ is directly below a longitudinal channel 78 that is formed by the angular separation between an adjacent pair of the upper cam bodies 72. Moreover, the channels 86 which are formed by the angular separation between adjacent lower cam bodies 72′ have radial centerlines that are offset with respect to the lower edges 79 of the inclined walls 75, so that as the cam bodies 72 move relatively downward, the surfaces 75 engage the lugs 71 to cause rotation of the mandrel 34. Each of the lugs 71 has an upper inclined surface 80 whose inclination matches the inclination of the walls 75, and a lower inclined surface 81 whose inclination matches the inclination of the walls 77. Thus arranged, upward longitudinal movement of the mandrel 34 causes the inclined surfaces 77 on each lower cam body 72′ to automatically engage a respective lug 71 on the index sleeve 46, so that the mandrel is forced to rotate counterclockwise, as viewed from above, through a certain angle as the lugs 71 find their way into the channels 86 as shown in phantom lines in FIG. 3. Then as the mandrel 34 is shifted back to its lower position, the lower surfaces 75 of the upper cam bodies 72 automatically engage the inclined surfaces 80 on the lugs 71, and cause the mandrel 34 to again rotate counterclockwise through an additional angle until the lugs find their way into the channels 78 between the upper cam bodies 72. The radial centerlines of the adjacent upper channels 78 are formed at an angle in the range of from about 30°–180° and preferably at an angle of about a 45° to one another, with each of the lower channels 86 being in between the upper channels. When the channels are at a 45° angular spacing, each increment of angular rotation of the mandrel 34 during its upward movement is 20°, and during each downward movement it rotates an additional 25° in the same direction for a total orientation angle change of 45°. Each increment of rotation of the mandrel 34 is transmitted to the lower housing 56 by the splines 58, 58' so that the lower housing 56 also rotates counterclockwise relative to the upper housing 30 through corresponding angles. When the mandrel 34 is in the lower position, a lower set of inwardly directed splines 62 on the index sleeve 46 engage in the channels 86 to provide additional drive surfaces. Engagement of the lower end surfaces 63 with the upper end surface 64 of the lower housing 56 stops downward movement of the mandrel 34. The axial length of each lug 71, as shown in FIG. 3, is greater than the axial spacing between the upper and lower cam bodies 72, 72' so that there is no free-wheeling position in response to reactive torque.

To cause the mandrel 34 to move downward against the bias of the power spring 40 from its upper position as shown in FIGS. 2A and 2B to its lower position shown in FIG. 2C, a nozzle 85 is mounted in an internal annular recess 86 in a sleeve 90 which is threaded onto the lower end of the mandrel. The nozzle 85 is held by a snap ring 87 so as to be readily replaceable, and can be a standard device used in a drill bit to form a jet. O-rings 88 and 88' prevent fluid leakage. The diameter of the throat 89 of the nozzle 85 is much smaller than the seal diameter of the O-ring 38 on the mandrel piston 35 so that when drilling mud is pumped downwardly through the mandrel at a selected rate, a pressure drop is created across the nozzle 85 which generates a relatively large downward force on the mandrel. At a predetermined normal flow rate that is used during drilling, this force predominates over the upward bias force of the spring 40 and holds the mandrel 34 in its lower position where the spring is foreshortened, and where the lugs 71 on the sleeve 46 are in the upper channels 78 between the cam bodies 72 as shown in solid lines in FIG. 3. If the rate of mud flow through the mandrel 34 is reduced by a selected amount, the bias of the power spring 40 predominates and shifts the mandrel 34 to its upper position where the lugs 71 are in the channels 86 between the lower cam bodies 72'. During such upward movement, the inclined surfaces 81 on the lugs 71 encounter the inclined surfaces 77 on the lower cam bodies 72' and index the mandrel 34 and the lower housing 56 counterclockwise through an angle of 20°. The reactive torque, which also is in the counterclockwise direction, assists in causing such rotation. Then as the mud flow is increased to its normal drilling rate, the mandrel 43 shifts back downward to position the lugs 71 in the upper channels 78. During such downward movement, the upper inclined surfaces 80 of the lugs 71 engage the inclined surfaces 75 on the upper cam bodies 72 and cause indexing of the mandrel 43 and the lower housing 56 by an additional 25°, for a total of 45°. Again, such relative rotation is assisted by the reactive torque which also in the counterclockwise direction. Thus relative rotation through an angle of 45° occurs during each flow rate change cycle, and a total of eight cycles causes a total of 360° of relative rotation. Additional increments of rotation beyond 360° can be accomplished by additional flow rate change cycles, and indeed the number of incremental angular movements is unlimited. Since the upper housing 30 and the tool string components thereabove are connected to the lower end of the coiled tubing 12, and since the lower housing 56 suspends the balance of the tool string components including the bent housing 26, each flow rate change cycle will cause 45° of rotation of the bent point B in the counterclockwise direction. The open throat of the nozzle 85 makes the orienting tool 21 compatible with certain wireline operations, since a wireline cable can be run therethrough.

The various internal spaces of the orienting tool 21 between the mandrel 34 and the upper and lower housings 30 and 56 are filled with a lubricating oil whose pressure is balanced with the pressure of the drilling mud below the lower end of the mandrel 34 by a floating piston 93 which is movable in an annular chamber 94 which is formed between the lower portion 95 of the lower housing 56 and the adjacent lower portion of the mandrel 34. The floating piston 93 carries inner and outer seal rings 98, 99 to prevent leakage past it. As the mandrel 34 shifts upward and then back downward, the piston 93 moves in the same directions and by the same distance relative to the lower housing 56, since the seal rings 99 and 38 preferably seal on the same diameter. The floating piston 93 serves to provide a separation between the lubricating oil and the drilling mud which is present in the region 100 below it, and also serves to equalize the pressures of the lubricating oil with the mud pressures which exist in such region. The presence of the oil between the mandrel 34 and the upper and lower housings 30 and 56 minimizes wear on the lugs 71 and the cam bodies 72, 72', the splines 58 and other relatively moving parts, and prevent debris infiltration.

OPERATION

In operation, the various components of the directional drilling tool string 11 are assembled end-to-end as shown in FIG. 1, and connected to the outer end of the coiled tubing 12 which is wound on the reel 9 of the unit 8. The bent housing 26 of the motor 14 is adjusted at the surface to provide a desired bend angle Θ which will cause the borehole to be drilled along whatever radius of curvature is needed for a particular section of the borehole. Usually the angle is between ¾° and 2° for a medium or a long radius of curvature. The orienting tool 21 can be initially in any relative angular position within its range of settings. The MWD tool 24 is positioned inside the collar 23 so that substantially continuous measurements of hole direction and azimuth can be made and transmitted to the surface as drilling proceeds. The drill bit 13 can be any suitable type such as a diamond bit or the like.

The string is lowered into the well bore as the coiled tubing 12 is fed into the top of the well by the injector 7 of the unit 8. Since there are no threaded joint connections to be made up, the tool string 11 can be run very rapidly to near the bottom of the borehole 10. The continuous nature of the coiled tubing 12 also permits it to be run into the well through the stripper 6 under pressure. With the bit 13 just off bottom, surface pumps are started to initiate mud circulation down through the coiled tubing 12, the mud motor 14 and out the jets of the bit 13. The mud is circulated at a rate which gives a desired rpm for the motor 14 and the bit 13. The MWD tool 24 will begin to transmit signals from which inclination and azimuth can be determined, as well as toolface angle which is a specialized presentation or display of the orientation of the bent housing or sub with respect to the high sides of the borehole. Adjustments can be made to achieve the proper heading by cycling the mud flow rate to operate the orientation sub 21. When the appropriate toolface angle, is attained the string of drilling tools 11 is lowered to cause the bit 13 to engage and begin to grind away the rock at the bottom of the borehole 10. A selected amount of the weight of the coiled tubing 12 is slacked-off on the bit 13 to achieve a desired rate of penetration. Alternatively, the orienting sub 21 can be actuated while the bit 13 is drilling on bottom.

Figure 4:
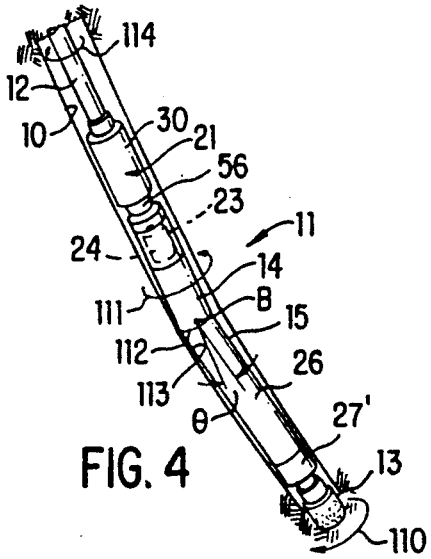
FIG. 4 is a schematic illustration of a directional drilling tool string being operated in a borehole.

As shown schematically in FIG. 4, as the bit 13 turns in a clockwise direction on bottom, as indicated by the arrow 110, while a portion of the weight of the coiled tubing 12 is imposed upon it, a reactive torque in the counterclockwise direction is applied to the bent housing 26 of the motor 14 as shown by the arrow 111. The magnitude of the reactive torque 111 is directly proportional to the amount of weight that is applied to the bit 13, and increases from a negligible amount when the bit first touches bottom to a maximum amount at stall of the motor 14. Since the outermost side 112 of the "elbow" of the bent housing 26 engages the side 113 of the borehole 10, the reactive torque 111 on the bent housing produces a lateral force in a leftward direction on the bit 13 which tends to cause it to drill to the side as the hole is deepened. The reactive torque 111 is opposed by a right hand torque, indicated by the arrow 114, which is generated by reaction at the lower end of the coiled tubing 12, which responds somewhat like a torsion spring. The net result is that the bend point B will remain oriented at whatever angle it has been positioned with respect to the low side of the borehole 10.

Figure 5:
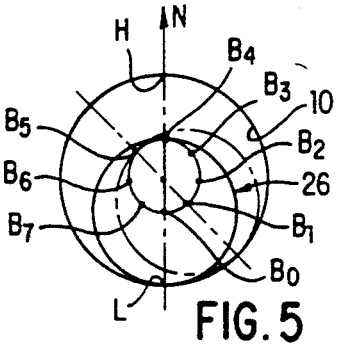
FIG. 5 is a schematic diagram showing angular orientations of the bent point in a plane that is perpendicular to the axis of the borehole.

FIG. 5 shows schematically the various orientation angles for the bend point B. As an example, a deviated borehole 10 is shown with the lower side of the elbow of the bent housing 26 laying against the low side L of the hole, which for example is toward the South. The bend point is shown at $B_0$, so that the toolface angle is 0°, or North. When the orienting sub 21 is indexed once, the bend point will rotate in the counterclockwise direction to $B_1$, so that the toolface angle becomes −45°. The other orientations of the bent point which are attained by successive operations of the orienting sub 21 are shown as $B_2$–$B_7$. In each position, the toolface angle of the bit 13 will be displayed at the surface as an angle between 0° and +180° where the borehole will curve to the right, up or down; and between 0° and −180° where the borehole will curve to the left, up or down. In the $B_0$ orientation, a lateral force is applied to the bit 13, and at the $B_1$ orientation another lateral force is applied. The same thing occurs at each of the orientations. The magnitude of the lateral force in each orientation is a function of the amount of weight that is applied to the bit 13, which controls the level of the bit torque, the reactive torque, and wind-up angle.

In practice, if a northerly azimuth for the borehole 10 is desired, the orienting sub 21 is indexed by repeatedly reducing and then increasing the mud flow rate until the bend point is at $B_7$, which provides a positive toolface angle that is somewhat to the right of the 0° reference. Then as drilling is started, a level of WOB is applied which causes the reactive torque on the bent housing 26 and the wind-up angle in the coiled tubing 12 to bring the toolface angle to a 0° heading. The signals from the MWD tool 24 which represent the azimuth and toolface angles will almost immediately inform the operator at the surface whether the borehole 10 will proceed as planned, and if no, the WOB can be adjusted to change the bit torque, the reactive torque and the magnitude of the lateral force. The same procedures are followed for any orientation of the bend point $B_0$–$B_7$.

Figure 6A:
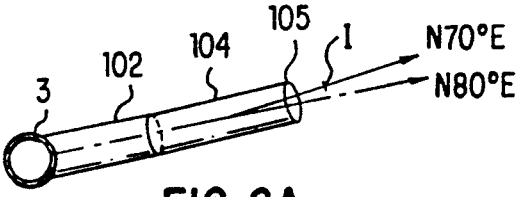
FIGS. 6A and 6B are schematic illustrations of a borehole being drilled in accordance with the present invention.
Figure 6B:
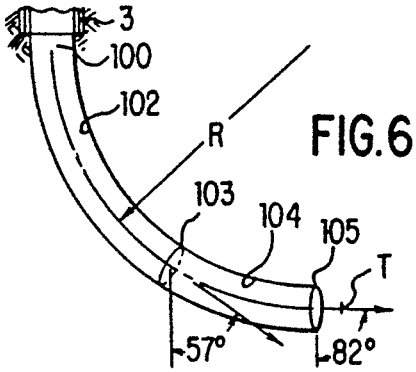

FIGS. 6A and 6B show schematically a simplified example of how a directional borehole can be drilled through use of the present invention. FIG. 6A shows a directional borehole as viewed looking down at it from the surface, and FIG. 6B shows the same borehole as it would appear from the right side thereof. To drill the section 102 which kicks off from the vertical at the point 100 at or near the bottom of the casing 3, a bend angle Θ is established at the surface in the bent housing 26, which will cause the section 102 to be drilled along a path having a radius R until it reaches point 103. At the beginning point 100, the bent housing 26 is oriented by the orienting sub 21, and as measured by the MWD tool 24 during circulation off bottom, such that the bend point B is at position $B_6$, or slightly to the right of a desired azimuth of N80° E. As the bit 13 begins to rotate on bottom, the WOB is adjusted so that the reactive torque 111 produces a wind-up angle in the coiled tubing 12 which causes the borehole to be drilled along the desired azimuth value of N80° E. until it reaches the lower end 103 of section 102. At this point the inclination of the borehole on account of the bend angle has built up, for example, to 57° off vertical as shown in FIG. 6B. As viewed in FIG. 6A, of course the section 102 of the borehole 10 appears to be straight, however FIG. 6B illustrates its actual curvature.

To then drill the borehole to a target point T, which is at a distal point that is below and to the left of point 103, the lower section 104 of the hole must be curved somewhat to the left as the inclination angle continues to build up. To accomplish this, the WOB is increased to produce a correspondingly increased wind-up angle, which causes the bit 13 to drill to the left of its previous trajectory. Such leftward drift continues until the azimuth gradually changes to N70° E. as shown at point 105 in FIG. 6A, which is on the target point T. As shown in FIG. 6B, as the section 104 is drilled the inclination gradually builds up from 57° to 82° which also causes the borehole to intersect the target point T.

If either of the borehole sections 102 or 104 drifts off course as shown by the data transmitted uphole by the MWD tool 24, in addition to, or in lieu of, other remedial steps, the orientation tool 21 can be indexed to another orientation angle by the steps of temporarily reducing and then increasing the mud flow rate. Such indexing will provide some different orientation of the bend point B as shown in FIG. 5, that will enable the azimuth of the borehole to be brought back on course. Of course the sub 21 can be indexed all the way around past any initial setting to achieve other settings that will correct the azimuth to a desired value. Of course the inclination and azimuth values inform the driller as to the current direction of the borehole, and the toolface angle informs the driller which way the borehole should curve.

It now will be apparent that new and improved directional drilling procedures and tool string components have been disclosed. Although the present invention has been described as particularly applicable to direction drilling on coiled tubing, the orienting sub could be used in a drilling tool string that is run on conventional pipe as an available means to accomplish steering of the bit, in addition to the steering that can be accomplished by turning the pipe at the surface. The sub also could be used to orient a jetting assembly that is used, for example, to destroy a casing shoe with abrasive laden fluids. It also is within the scope of the present invention for the cam bodies 72, 72' to be on the sleeve 46 and the lugs 71 to be on the mandrel 34. Since certain changes or modifications may be made in the disclosed embodiments without departing from the invention concepts involved, it is the aim of the appended claims to cover all such changes and modifications falling within the true spirit and scope of the present invention.

What is claimed is:

1. An orienting apparatus for use in a directional drilling tool string that includes a mud motor which drives a drill bit and has a bent housing that defines a bend point, said tool string being suspended in a borehole on a running string, comprising: an upper housing; a lower housing rotatable with respect to said upper housing; a mandrel movable longitudinally relative to said upper housing and said lower housing between a lower position and an upper position; differential pressure responsive means for shifting said mandrel downward to said lower position; yieldable means opposing said downward movement and causing upward movement of said mandrel when said differential pressure is reduced; and means responsive to said upward and downward movements for changing the orientation of said lower housing relative to said upper housing by a selected angular amount.

2. The apparatus of claim 1 wherein said changing means comprises indexing means including lug means fixed on said upper housing, and axially spaced upper and lower cam means on said mandrel cooperable with said lug means during said upward and downward movements for producing a change in said angular orientation.

3. The apparatus of claim 2 wherein said cam means includes helically inclined surfaces cooperable with said lug means for automatically turning said mandrel and said lower housing relative to said upper housing in the same rotational direction in response to said upward and downward movements.

4. The apparatus of claim 3 wherein said upper and lower cam means include angularly spaced projections on the outer periphery of said mandrel which define angularly spaced longitudinal channels therebetween so that a predetermined number of said downward and upward movements will revolve said mandrel and said lower housing through and beyond 360° of rotation relative to said upper housing.

5. The apparatus of claim 1 further including liquid-filled chamber means formed between said upper and lower housings and said mandrel; and floating piston means for preventing drill mud and debris from contaminating said liquid and for equalizing the pressure of drilling mud flowing through said apparatus with the liquid in said chamber means.

6. The apparatus of claim 1 wherein said differential pressure responsive means includes a flow restriction in the bore of said mandrel for creating a pressure drop due to the rate of flow of drilling mud therethrough, said pressure drop generating pressure forces which act on said mandrel to shift said mandrel downward to said lower position.

7. The apparatus of claim 6 wherein said yieldable means includes spring means reacting between said mandrel and said upper housing and biasing said mandrel toward said upper position.

8. The apparatus of claim 1 further including means for connecting said upper housing to the lower end of said running string, and means for connecting said lower housing member to the upper end of a measuring-while-drilling tool.

9. A directional drilling tool string adapted to be suspended in a borehole on coiled tubing, comprising: a drilling motor operated by the flow of drilling mud therethrough for rotating a drill bit at the lower end thereof, said drilling motor including a bent housing that defines a bend angle and a bend point which causes the bit to drill along a directional path; and a downhole adjustable orienting sub located in said tool string above said motor, said sub having first and second relatively rotatable housing members, one of said housing members being connected to said coiled tubing and the other of said housing members being connected to said motor, and selectively operable means for changing the relative angular orientation of said housing members to control the azimuth of said directional path.

10. The tool string of claim 9 wherein said selectively operable means includes cam and follower means responsive to longitudinal movement for indexing said other housing member relative to said one housing member through a predetermined angle of relative rotation.

11. The tool string of claim 10 wherein said selectively operable means further includes a mandrel mounted in said housing members and carrying one of said cam and follower means, said mandrel being movable longitudinally relative to both of said housing members to cause said indexing.

12. The tool string of claim 11 wherein said mandrel has flow restriction means in the bore thereof, said restriction means being responsive to a change in the flow rate of drilling fluids therethrough to effect longitudinal movement of said mandrel.

13. The tool string of claim 12 wherein said mandrel moves downward in response to an increase in said flow rate, and further including resilient means for moving said mandrel upward as said flow rate is reduced.

14. The tool string of claim 12 wherein said cam and follower means is located in an enclosed chamber that is filled with lubricating oil, and further including means for balancing the pressure of said lubricating oil with the pressure in said other housing member below said mandrel.

15. A method of providing a selected angular orientation in a borehole of the bent housing or sub that is operatively associated with a downhole drilling motor which drives a drill bit and which is suspended in the borehole on a string of coiled tubing, comprising the steps of: providing an orientation sub having an upper housing that is connected to the coiled tubing and a lower housing that is connected to said motor, said lower and upper housings being rotatable relative to one another from a first to a second angular position; rotationally indexing said upper and lower housings relative to one another so that said lower housing rotates counterclockwise to said second angular position; and using the counter-clockwise torque that is applied to said orientation sub as said bit is rotated on bottom by said motor to ensure complete rotation of said upper housing to said second position.

16. The method of claim 15 including repeating said indexing and using steps to cause said upper housing to rotate relative to said lower housing to other relative angular positions.

17. The method of claim 16 wherein each of said indexing steps is carried out in response to changing the flow rate of fluids being pumped through said motor via said coiled tubing.

18. The method of claim 17 including the further steps of measuring components of the earth's gravity and magnetic fields adjacent said motor, transmitting signals to the surface which are representative of such measuring; and determining from said signals the inclination and azimuth of the borehole and the toolface angle.

19. A method of drilling a directional borehole using a downhole motor that drives a drill bit, said motor having a bent housing and being suspended in said borehole on a string of coiled tubing, said bent housing providing a bend angle which defines a bend point and which causes the bit to drill along a curved trajectory, comprising the steps of: providing an orienting sub above said motor having relatively rotatable housing members, one of said housing members being connected to the lower end of said coiled tubing and the other of said housing members being connected to the upper end of said motor, indexing said orienting sub to provide a selected angular orientation of said one housing member relative to said other housing member and a corresponding orientation of said bend point about the center of the borehole; and operating said motor while applying a selected amount of the weight of said coiled tubing to said bit which produces a reactive torque on said bent housing and a lateral force on said bit.

20. The method of claim 19 including the further step of varying the amount of said weight on said bit in a manner that produces a change in the magnitude of said reactive torque.

21. The method of claim 19 including the further step of performing additional indexing of said orienting sub to obtain other selected angular orientations of said bend point about said center of said borehole to achieve different headings of said bit.

22. The method of claim 19 wherein said indexing step is carried out by temporarily reducing and then increasing the flow rate of drilling fluids being pumped down said coiled tubing and through said motor.

23. The method of claim 19 including the further steps of measuring components of the earth's gravity and magnetic fields in the borehole adjacent said motor; transmitting signals to the surface which are representative of such components; and determining inclination and azimuth of the borehole from said signals, and toolface angle.

* * * * *

Adverse Decisions In Interference

Patent No. 5,311,952, Alan Eddison, Lawrence J. Leising, Charles Ingold, APPARATUS AND METHOD FOR DIRECTIONAL DRILLING WITH DOWNHOLE MOTOR ON COILED TUBING, Interference No. 104,055, final judgment adverse to the patentees rendered July 23, 1998 as to claims 1-4, 6-13 and 15-23.

*(Official Gazette October 27, 1998)*